US011428107B2

(12) United States Patent
Shi et al.

(10) Patent No.: US 11,428,107 B2
(45) Date of Patent: Aug. 30, 2022

(54) PREFORMS SYSTEM FOR CMC BLADES

(71) Applicants: Rolls-Royce Corporation, Indianapolis, IN (US); Rolls-Royce High Temperature Composites Inc., Cypress, CA (US)

(72) Inventors: Jun Shi, Carmel, IN (US); Steffan Brown, Long Beach, CA (US)

(73) Assignees: ROLLS-ROYCE CORPORATION, Indianapolis, IN (US); ROLLS-ROYCE HIGH TEMPERATURE COMPOSITES INC., Cypress, CA (US)

( * ) Notice: Subject to any disclaimer, the term of this patent is extended or adjusted under 35 U.S.C. 154(b) by 440 days.

(21) Appl. No.: 16/429,909

(22) Filed: Jun. 3, 2019

(65) Prior Publication Data

US 2020/0378265 A1 Dec. 3, 2020

(51) Int. Cl.

| | |
|---|---|
| ***F01D 5/28*** | (2006.01) |
| ***F01D 5/34*** | (2006.01) |
| *F01D 5/14* | (2006.01) |

(52) U.S. Cl.

CPC ..... *F01D 5/282* (2013.01); *F01D 5/284* (2013.01); *F01D 5/34* (2013.01); *F01D 5/147* (2013.01); *F05D 2300/6033* (2013.01); *F05D 2300/614* (2013.01)

(58) Field of Classification Search

CPC . F01D 5/28; F01D 5/282; F01D 5/284; F01D 5/34; F01D 5/147; F05D 2300/6033; F05D 2300/614; B32B 18/00; B32B 38/004; B32B 2038/045; B32B 43/003; B23B 2603/00; B23P 15/02

See application file for complete search history.

(56) References Cited

U.S. PATENT DOCUMENTS

| | | | | |
|---|---|---|---|---|
| 5,205,716 | A * | 4/1993 | Georges | F01D 5/025 416/229 A |
| 5,222,866 | A * | 6/1993 | LaBrouche | F01D 5/34 416/230 |
| 5,759,688 | A * | 6/1998 | Lee | C04B 35/62873 428/408 |
| 5,921,754 | A * | 7/1999 | Freitas | B29D 99/0025 416/230 |
| 6,110,555 | A | 8/2000 | Katz et al. | |
| 6,595,751 | B1 * | 7/2003 | Straub | F01D 5/066 416/170 R |
| 8,177,933 | B2 | 5/2012 | Foucault et al. | |
| 9,457,531 | B2 | 10/2016 | Ortiz | |
| 9,931,818 | B1 * | 4/2018 | Parolini | C04B 35/80 |

(Continued)

*Primary Examiner* — Brian P Wolcott
*Assistant Examiner* — Joshua R Beebe
(74) *Attorney, Agent, or Firm* — Crowell & Moring LLP

(57) ABSTRACT

A bladed disk preform system is provided. Multiple sheets are formed or provided. Each of the sheets may include multiple ceramic fibers. Slots may be cut in each of the sheets before or after forming. The slots extend from an outer edge of the sheets inward toward a center of the sheets. The sheets are stacked on top of each other to form a bladed disk preform. The bladed disk preform is porous. The bladed disk preform may include a plurality of blade portions extending outward from a root portion. Each of the slots is positioned between adjacent blade portions.

16 Claims, 7 Drawing Sheets

(56) References Cited

U.S. PATENT DOCUMENTS

| | | | | |
|---|---|---|---|---|
| 2009/0092494 | A1* | 4/2009 | Cairo | F01D 5/3061 416/204 R |
| 2018/0016924 | A1* | 1/2018 | Gallier | F01D 25/246 |
| 2018/0290391 | A1* | 10/2018 | Corsmeier | B29C 66/70 |
| 2020/0072078 | A1* | 3/2020 | Decesare | F23R 3/007 |

* cited by examiner

PREFORMS SYSTEM FOR CMC BLADES

TECHNICAL FIELD

The present disclosure relates to systems and methods related to a blade for a gas turbine engine.

BACKGROUND

Present airfoil manufacturing methods and resulting airfoils suffer from a variety of drawbacks, limitations, and disadvantages. Accordingly, there is a need for inventive methods, and components.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

In one example, a method is provided in which a plurality of sheets are formed or provided. Each of the sheets has a disk shape and includes a plurality of ceramic fibers. Slots are cut in each of the sheets. The slots extend from an outer edge of the sheets inward toward a center of the sheets. The sheets are stacked on top of each other to form a bladed disk preform. The bladed disk preform is porous. The bladed disk preform includes a plurality of blade portions extending radially outward from a root portion. Each of the slots is positioned between adjacent blade portions.

In another example, a method for manufacturing the bladed disk preform for a gas turbine engine is provided. A plurality of sheets are formed or provided. Each of the sheets has a disk shape and includes a plurality of ceramic fibers. The sheets are stacked on top of each other to form a porous preform. The porous preform has an outer edge. A plurality of slots are cut in the porous preform. The slots extend from the outer edge inward toward a center of the porous preform to define a bladed disk preform. The bladed disk preform includes a plurality of blade portions and a root portion.

One interesting feature of the systems and methods described below may be that multiple ceramic matrix composite (CMC) blades and root portions are manufactured from a single bladed disk preform. Alternatively, or in addition, an interesting feature of the systems and methods described below may be that the bladed disk preform is segmented, and each segment includes at least two blade portions. After infiltration, curing, and machining of the bladed disk preform segment, each resultant CMC bladed disk segment is attachable to a hub of a gas turbine engine.

Figure 1:
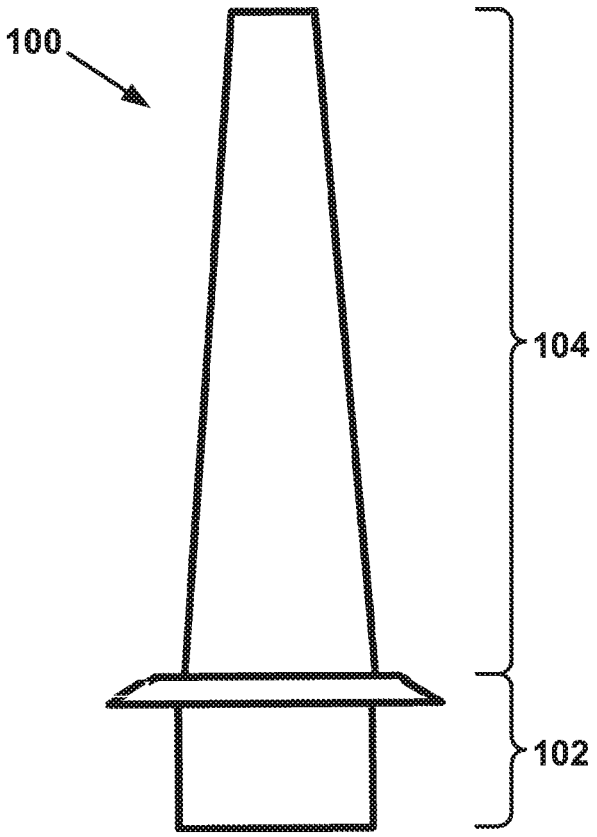
FIG. 1 illustrates a schematic drawing of a portion of a bladed disk preform.

FIG. 1 is a schematic view of a portion of a bladed disk preform 100 for a gas turbine engine. The gas turbine engine may supply power to and/or provide propulsion of an aircraft. Examples of the aircraft may include a helicopter, an airplane, an unmanned space vehicle, a fixed wing vehicle, a variable wing vehicle, a rotary wing vehicle, an unmanned combat aerial vehicle, a tailless aircraft, a hover craft, and any other airborne and/or extraterrestrial (spacecraft) vehicle. Alternatively or in addition, the gas turbine engine may be utilized in a configuration unrelated to an aircraft such as, for example, an industrial application, an energy application, a power plant, a pumping set, a marine application (for example, for naval propulsion), a weapon system, a security system, a perimeter defense or security system.

The gas turbine engine may take a variety of forms in various embodiments. In some examples, the gas turbine engine may be an axial flow engine. In other examples the gas turbine engine may have multiple spools and/or may be a centrifugal or mixed centrifugal/axial flow engine. In some forms, the gas turbine engine may be a turboprop, a turbofan, or a turboshaft engine. Furthermore, the gas turbine engine may be an adaptive cycle and/or variable cycle engine. Other variations are also contemplated.

The gas turbine engine may include a turbine section, a turbine, a turbine blade, an intake section, a combustion section, a shaft, an exhaust section, a compressor section, and a compressor blade. During operation of the gas turbine engine, fluid received from the intake section, such as air, may be received by and compressed within the compressor section. The compressed fluid may then be mixed with fuel and the mixture may be burned in the combustion section. The combustion section may include any suitable fuel injection and combustion mechanisms. The hot, high pressure fluid may then pass through the turbine section to extract energy from the fluid and cause a turbine shaft of a turbine in the turbine section to rotate, which in turn drives the compressor section. Discharge fluid may exit the exhaust section.

As noted above, the hot, high pressure fluid passes through the turbine section during operation of the gas turbine engine. As the fluid flows through the turbine section, the fluid passes between adjacent blades of the turbine causing the turbine to rotate. The rotating turbine may turn a shaft in a rotational direction. The blades may rotate around an axis of rotation, which may correspond to a centerline of the turbine in some examples.

FIG. 1 is a schematic view of a portion of a bladed disk preform 100 for a bladed disk. A bladed disk or bladed ring may be any component for a gas turbine engine including both a rotor disk and blades. The bladed disk preform 100 is porous. The bladed disk may have a root portion 102 and a blade portion 104 opposite the root portion 102. The bladed disk may be, for example, a blisk and/or integrally bladed rotor. In some examples the bladed disk preform 100 is a preform for a component of the bladed disk. In other examples, the bladed disk preform is a preform of an entire bladed disk. The bladed disk may be positionable in the turbine section of the gas turbine engine. Alternatively or in addition, the bladed disk may be positionable in the compressor section of the gas turbine engine.

The root portion 102 may be any portion of the bladed disk preform 100, which is configured to be fixed to a hub (not shown) of the shaft of the gas turbine engine. In some examples, the root portion 102 may have a dovetail shape. In another example, the root portion may be a 'fir-tree' attachment type. In some examples, the blade portions 104 may be contiguous with the root portion 102. Alternatively, the blade portions 104 may be coupled to the root portion 102. The root portion 102 may be in the shape of an annulus that defines a circular aperture.

The blade portion 104 may be any portion of the bladed disk preform 100 that includes a blade. Examples of the blade portion 104 include preforms for airfoils, such as turbine blades or vanes, compressor blades, and/or stators. In some examples, multiple blade portions 104 may be fixed to a single root portion 102.

Figure 2A:
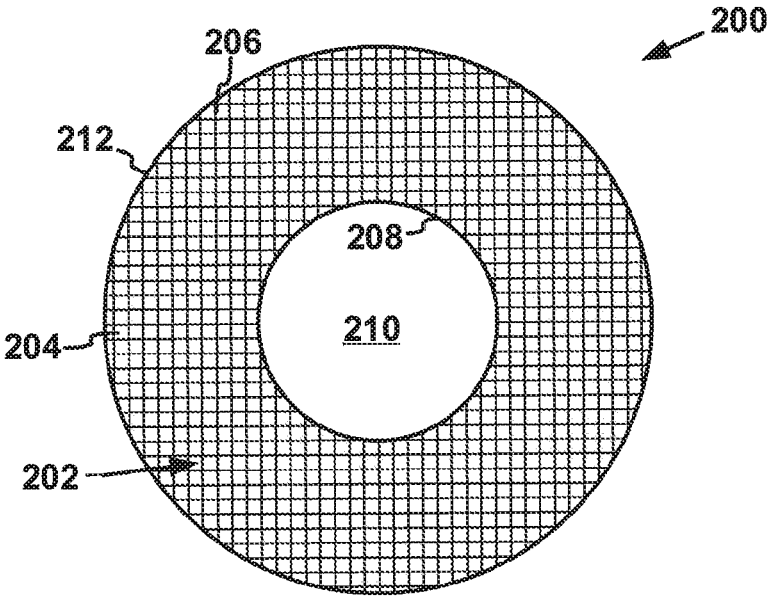
FIG. 2A illustrates a schematic drawing of an example of a sheet of ceramic material.
Figure 2B:
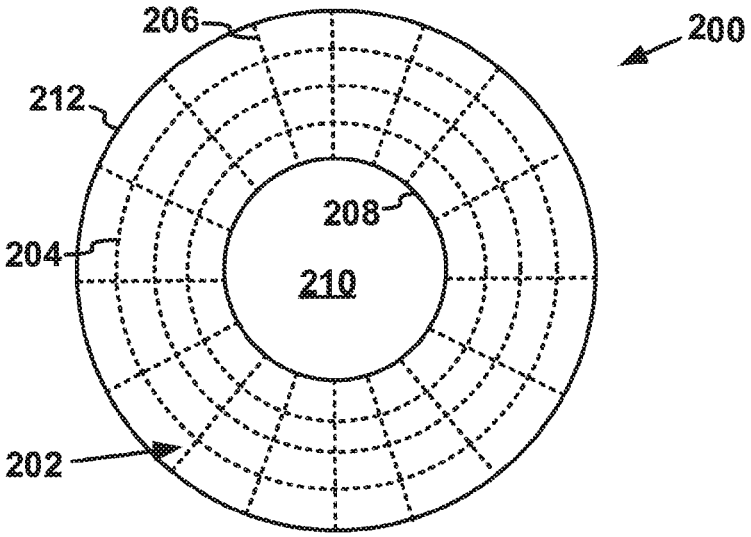
FIG. 2B illustrates a schematic drawing of another example of the sheet.

FIGS. 2A and 2B illustrate schematic views of a sheet 200 for manufacturing the bladed disk preform 100 that includes ceramic fibers 202. The sheet 200 may be any porous layer or layers of ceramic material configured to be stacked. In some examples, the sheet 200 may have an annular shape. In other examples, the sheet 200 may be rectangular, parabolic, square, or any other shape. In this example, the sheet 200 includes an inner edge 208 defining an aperture 210 and an outer edge 212 defining a perimeter of the sheet 200. The sheet 200 may include an arrangement of the ceramic fibers 202. The arrangement of the ceramic fibers 202 may be fixed in a predetermined shape. Examples of the sheet 200 may include woven cloths, woven sheets, unidirectional tape, polar woven cloths, two-dimensional weaves, and 3D woven structures.

The outer edge 212 or outer radial edge may be any peripheral edge or surface that defines a perimeter of the sheet 200. In some examples, the outer edge 212 is non-continuous and/or porous because it is defined by the ceramic fibers 202. In examples where the sheet 200 is circular, the outer edge 212 is an outer radial edge. In examples where the sheet 200 is not circular, the outer edge 212 may be any outer edge or surface that defines a perimeter of the sheet and may be rectangular, parabolic, square, or any other shape.

In some examples, each of the ceramic fibers 202 may be a bundle and/or a tow of ceramic fibers. The fibers in each bundle or tow may be woven, braided, or otherwise arranged.

The ceramic fibers 202 may be a material that is stable at temperatures above 1000 degrees Celsius. Examples of the ceramic fibers 202 may include fibers of alumina, mullite, silicon carbide, zirconia or carbon.

In some examples, the sheet 200 may include a first set 204 and a second set 206 of the ceramic fibers 202. The first set 204 may be transverse and/or angularly offset with respect to the second set 206. As shown in FIG. 2A, the ceramic fibers 202 may be woven and/or braided together in a cross-hatched pattern. In this example, the first set 204 is arranged perpendicular and/or orthogonal to the second set 206. Alternatively, as shown in FIG. 2B, the fibers may be woven and/or braided in a polar pattern. In this example, the first set 204 is arranged to extend radially outward from a center of the sheet 200. The second set 206 is arranged in a hoop pattern and/or in concentric arcs around the center of the sheet. In some examples the concentric arcs may be circular. In other examples the arcs may include other non-circular shapes.

In other examples, all of the ceramic fibers 202 may be arranged to run in the same direction. One of the first set 204 or the second set 206 of ceramic fibers 202 may be stronger than the other. In some examples the first set 204 and the second set 206 of ceramic fibers 202 may be made of the same material. Alternatively, in other examples, the first set 204 and the second set 206 of ceramic fibers may be made of a different material. In some examples the first set 204 and the second set 206 of the ceramic fibers 202 may have the same thickness. In other examples, the first set 204 and the second set 206 of the ceramic fibers 202 may have different thicknesses. For example, the first set 204 of ceramic fibers 202 may be thicker than the second set 206 of ceramic fibers 202.

Figure 3:
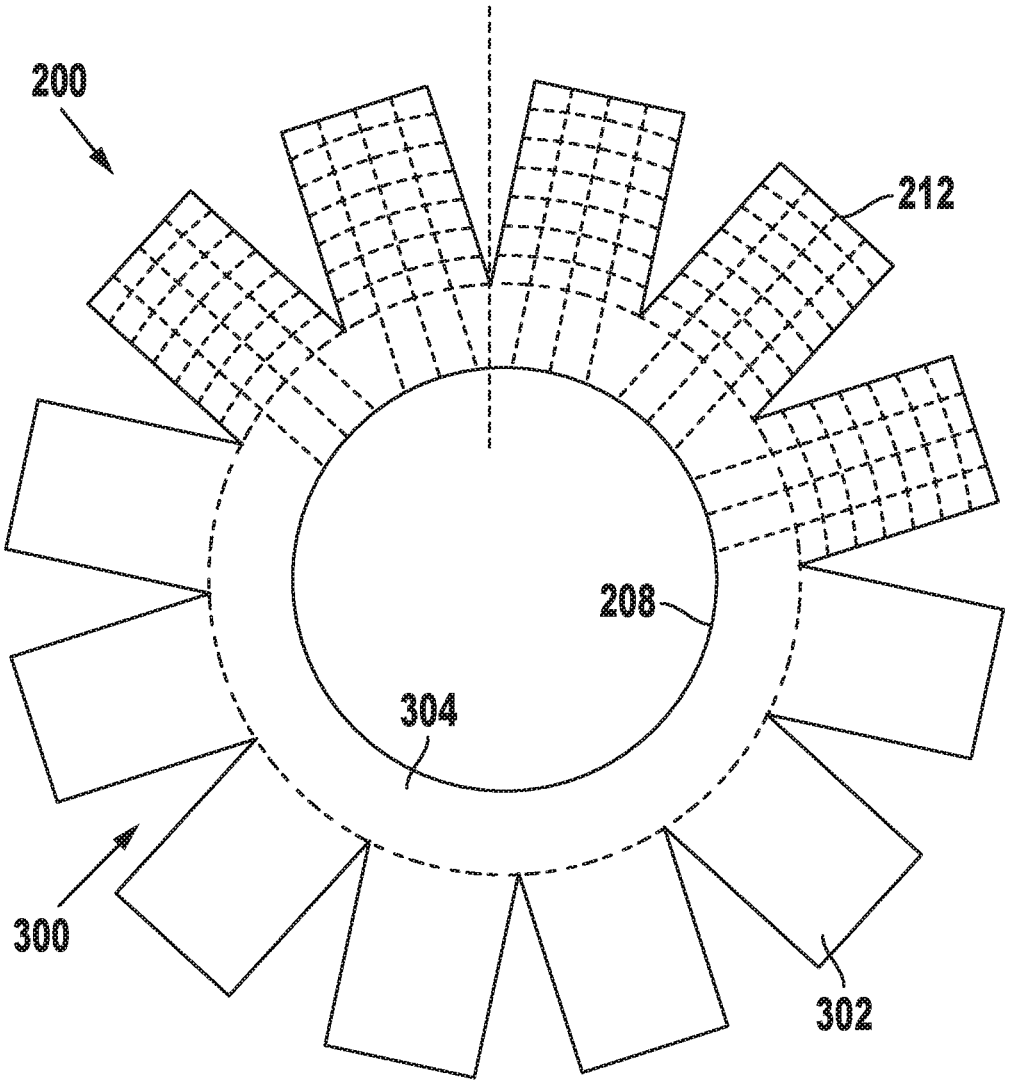
FIG. 3 illustrates a schematic drawing of yet another example of the sheet.

FIG. 3 illustrates a schematic example of the sheet 200 and/or a trimmed to size sheet 200, which includes multiple slots 300 extending from the outer edge 212 toward a center of the sheet 200. Alternatively or in addition, the slots 300 may be cutout from the inner edge 208 and extend toward edge the outer edge 212. The slots 300 may be any cutout arranged around the sheet 200. As shown in FIG. 3, the slots 300 may be wedge shaped. In other examples, the slots 300 may be different shapes. As shown in FIG. 3, the slots 300 may all be the same shape and size. The slots 300 may define multiple blade sheet portions 302 and a root sheet portion 304. The blade sheet portions 302 extends between the outer edge 212 and the root sheet portion 304. The root sheet portion extends between the blade sheet portion 302 and the inner edge 208.

The blade sheet portion 302 may be any layer that forms the blade portion 104 of the bladed disk preform 100 when multiple sheets 200 are stacked together.

The root sheet portion 304 may be any layer that forms the root portion 102 of the bladed disk preform 100 when multiple sheets 200 are stacked together.

Figure 4A:
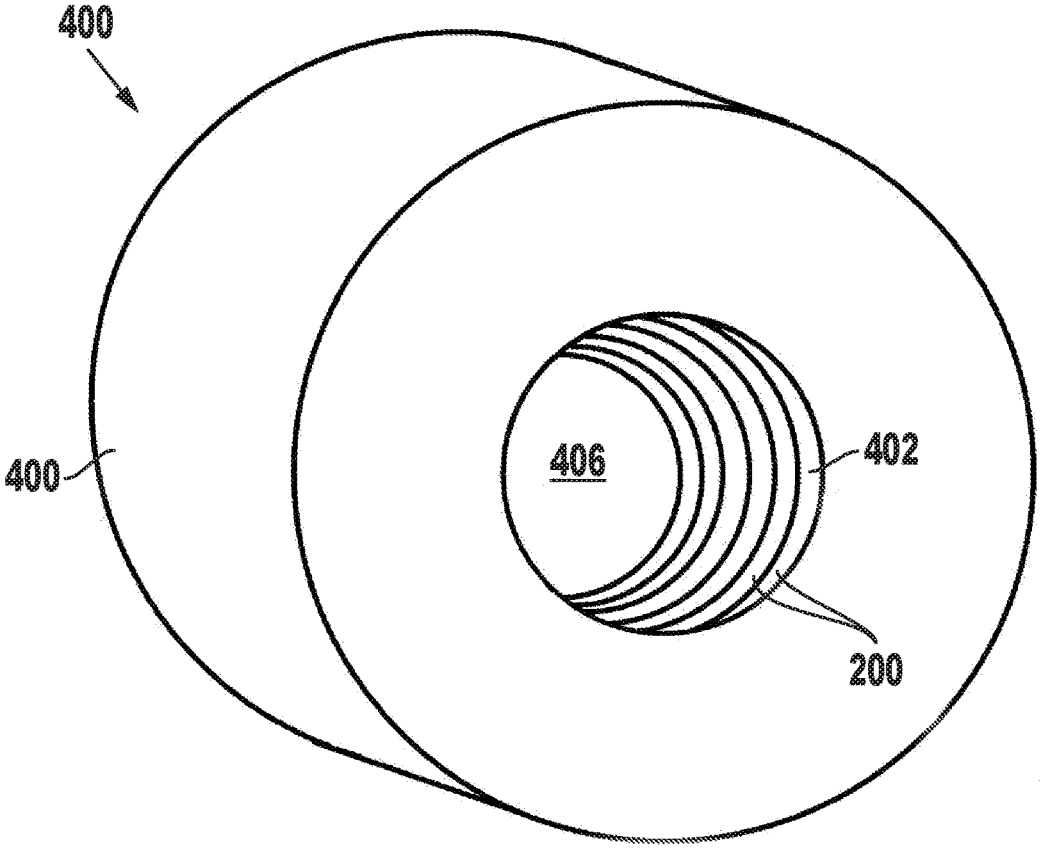
FIG. 4A illustrates a schematic drawing of a porous preform

FIG. 4A illustrates a schematic view of an example of a porous preform 400 which includes a plurality of stacked sheets 200. The porous preform 400 may be an uncut and/or slotless precursor to the bladed disk preform 100 shown in FIG. 4B. The porous preform 400 may have an inner radial surface 402 and an outer surface 404. The inner radial surface 402 may define a preform aperture 406.

Figure 4B:
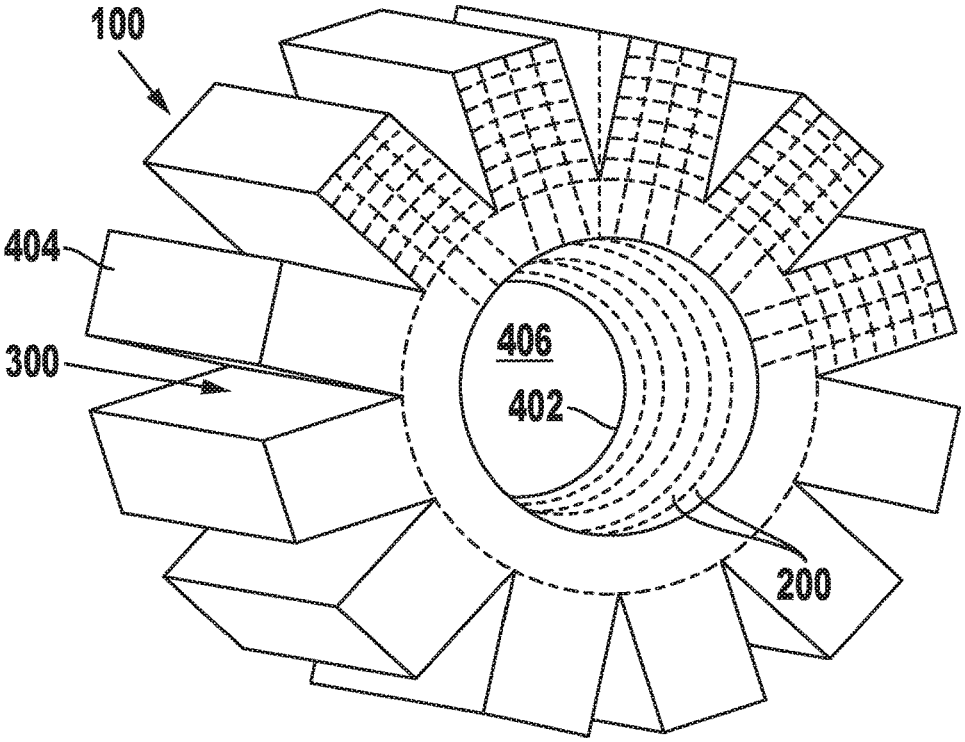
FIG. 4B illustrates a schematic drawing of a bladed disk preform.

FIG. 4B illustrates a schematic view of an example of the bladed disk preform 100, which is formed from stacked sheets 200. The bladed disk preform 100 may include the root portion 102, multiple blade portions 104, and the slots 300 formed between respective blade portions 104. The root portion 102 may define the inner radial surface 402. The blade portions 104 may define the outer surface 404 of the bladed disk preform 100. Examples of the bladed disk preform 100 may include an annulus, a hoop, and/or a solid, substantially cylindrical piece. The root sheet portions 304 of each respective sheet 200 may together define the preform aperture 406 extending through the bladed disk preform 100.

The inner radial surface 402 may be any surface and/or edge that defines the preform aperture. The inner radial surface 402 may be defined by the inner edges 208 the stacked sheets 200. The inner radial surface 402 may be a non-continuous and/or porous surface.

The outer surface 404 may be any surface and/or edge that defines an outer periphery of the bladed disk preform 100. The outer surface 404 may be defined by the outer edges 212 of the stacked sheets 200. The outer surface 404 may be a non-continuous and/or porous surface. In examples where the sheets 200 are circular and the porous preform 400 is cylindrical, the outer surface 404 may be an outer radial surface. In examples where the sheets 200 are not circular or the porous preform 400 is not cylindrical, the outer surface 404 may be any outer, peripheral surface that defines a perimeter of the porous preform 400 or the bladed disk preform 100. For example, the outer surface 404 may define a rectangular prism, cube, or any other shape.

The aperture of the sheet 200 and/or the preform aperture 406 may include a substantially circular and/or cylindrical perimeter having a length and a diameter. The length and/or the diameter may vary depending on the requirements of a given gas turbine engine. For example, as the diameter of the preform aperture 406 decreases, the length of the root portion 102 increases. If the root portion 102 is longer, it may extend further radially into the hub, which may limit problems caused by larger thermal expansion mismatches and higher thermal stresses.

In one example, a method of manufacture may be implemented to produce the bladed disk preform 100. Multiple sheets 200 of ceramic material are provided and/or formed. The sheets may be disk shaped, which means that sheets 200 may be flat, thin, and circular like a disk. The sheets 200 may include multiple ceramic fibers 202. Each of the sheets 200 has an outer edge 212. A substantially circle shaped hole may be cut into each of the sheets 200, such that the sheets 200 are annular. The slots 300 are cut into each sheet 200. Examples of cutting may include cutting manually with a blade or automated cutting with a computer numerical control (CNC) guided blade. The slots 300 extend from the outer edge 212 inward toward a center of the respective sheet 200. The cut sheets 200 are then stacked, formed, and locked into shape with a fugitive binder material, so that the blade sheet portions 302 and the root sheet portion 304 of the respective sheets 200 are aligned with each other, so that the bladed disk preform 100 is formed having multiple blade portions 104 extending from the root portion 102.

In another example, a different method of manufacture may be implemented. In this example, multiple sheets 200 of ceramic material are provided. The sheets 200 are stacked, formed, and locked into shape with the fugitive binder material so that each respective outer edge 212 and inner edge 208 of each sheet 200 are aligned to form the porous preform 400. As shown in FIG. 4A, in some examples the porous preform 400 is a hollow, annular cylinder. In other examples, the porous preform may be a solid cylinder. The slots 300 are cut in the outer surface 404 of the porous preform 400 to define the bladed disk preform 100, which includes the blade portions 104 extending from the root portion 102. The slots 300 are arranged around the bladed disk preform 100 between adjacent blade portions 104.

Each component may include additional, different, or fewer components. For example, the bladed disk preform may include only the blade portions 104 and the root portion 102. The blade portions 104 and the root portion 102 may be one unitary piece. In other examples, the bladed disk preform 100 may include, the blade portions 104, the root portion 102, and a hub portion as one unitary piece. It further examples, the bladed disk preform may include only the blade portions 104 and no root portion 102. In some examples, the bladed disk preform 100 may be mounted to the gas turbine engine as one unitary piece. In some examples, the unitary piece may be a contiguous annular structure. In other examples, the unitary piece may include multiple unitary pieces coupled together to define an annular structure. In other examples, individual pieces having one or more blade portions 104 may be cut from the bladed disk preform. In some examples, each individual piece may have two blade portions 104. In other examples, each individual piece may have three or more blade portions 104.

In some examples, the root portion 102 may include a series of holes with corresponding rods, such that the rods extend through the hub and the holes of the root portion, coupling the root portion to the hub.

The blade portions 104 may be preforms for cooled or uncooled blades. Blade portions 104 for uncooled blades may be substantially solid with no cooling passages defined therein. Alternatively, the blade portions 104 for cooled blades may include a plurality of cooling passages, plenums, channels and/or capillaries. In this example, the blade portions 104 may include sacrificial fibers which are removed after infiltration defining an opening in the resulting CMC bladed disk.

Figure 5:
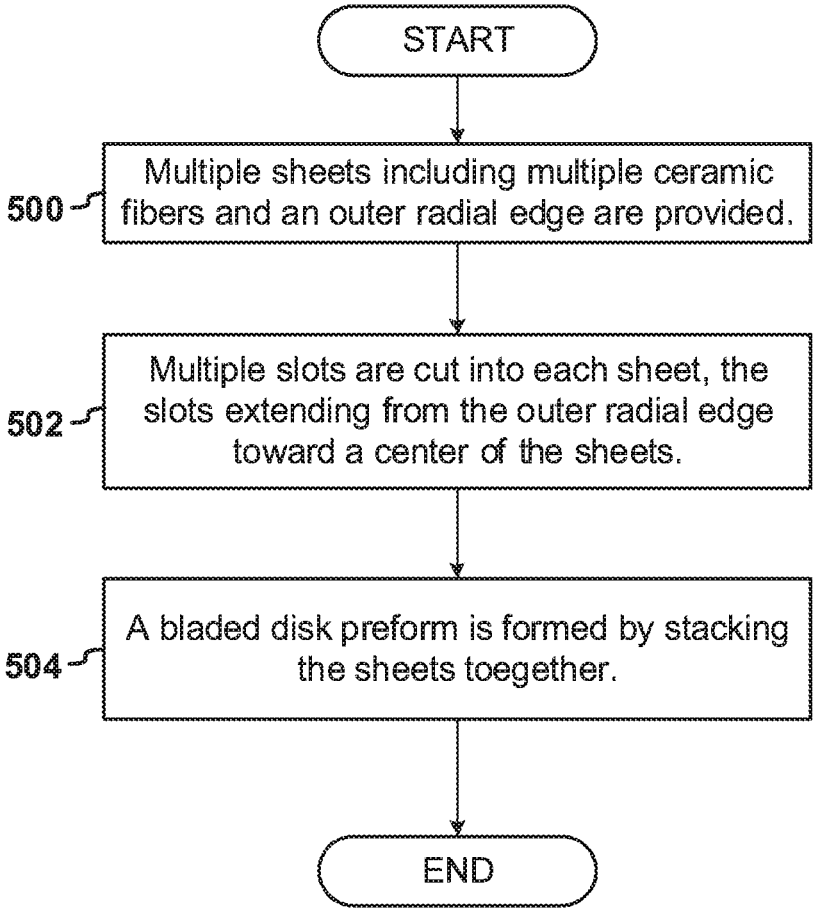
FIG. 5 illustrates a flow chart for a method of manufacture of the bladed disk preform.

FIG. 5 illustrates a flow diagram of an example of steps to manufacture the bladed disk preform 100. Multiple sheets 200 including multiple ceramic fibers 202 and the outer edge 212 are provided (500). Multiple slots 300 are cut into each sheet 200, the slots 300 extending from the outer edge 212 toward the center of the sheets (502). The bladed disk preform 100 is formed by stacking the sheets 200 together, forming the stack, and locking in the geometry with the fugitive binder (504).

Figure 6:
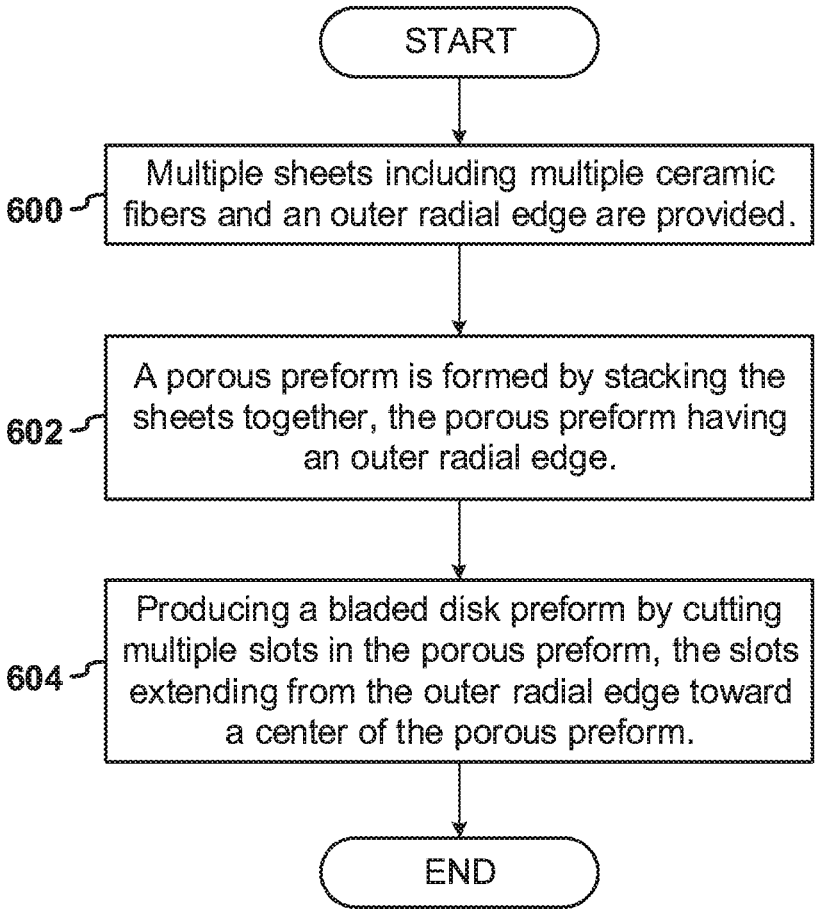
FIG. 6 illustrates a flow chart for another method of manufacture of the bladed disk preform.

FIG. 6 illustrates a flow diagram of another example of steps to manufacture the bladed disk preform 100. Multiple sheets including multiple ceramic fibers and an outer edge are provided (600). A porous preform is formed by stacking the sheets together forming the stack, and locking in the geometry with the fugitive binder, the porous preform having the outer surface (602). Producing a bladed disk preform by cutting multiple slots in the porous preform, the slots extending from the outer edge toward a center of the porous preform (604).

The steps may include additional, different, or fewer operations than illustrated in FIGS. 5 and 6. For example, after the bladed disk preform 100 is formed, the bladed disk preform 100 may be formed into a ceramic matrix composite (CMC) bladed disk by infiltrating a molten metal or alloy (for example, a silicon metal or alloy) into the bladed disk preform 100. The root portion 102 of the CMC bladed disk may then be cut between adjacent blade portions 104 to produce CMC blade segments. The root portion 102 may be cut along a plane extending through the root portion 102 between adjacent blade portions 104. The CMC blade segments may have a root portion and two or more blade portions extending therefrom. The CMC blade segments may then be fixed to the hub of the gas turbine engine. Alternatively, the bladed disk preform 100 may be cut into segments before infiltration. Then, each of the resulting bladed disk preform segments is infiltrated with the molten metal or alloy.

Infiltration of the bladed disk preform 100 and/or the bladed disk preform segments may include filling gaps between the ceramic fibers 202 with the molten metal or alloy. The silicon metal or alloy may react with a reactive element source present in the bladed disk preform 100 to form additional silicon based ceramic matrix material. In some examples, a chemical vapor infiltration coating may be applied to the bladed disk preform 100 prior to melt infiltration to stiffen the ceramic fibers 202. Alternatively or in addition, forming the CMC bladed disk from the bladed disk preform 100 may include chemical vapor infiltrating the bladed disk preform 100 instead of melt infiltrating a material into the bladed disk preform 100. Examples of the infiltration may further include chemical vapor deposition (CVD) interface coating, chemical vapor infiltration (CVI) of a silicon carbide compound (SiC), slurry infiltration, and/or melt infiltration.

Figure 7:
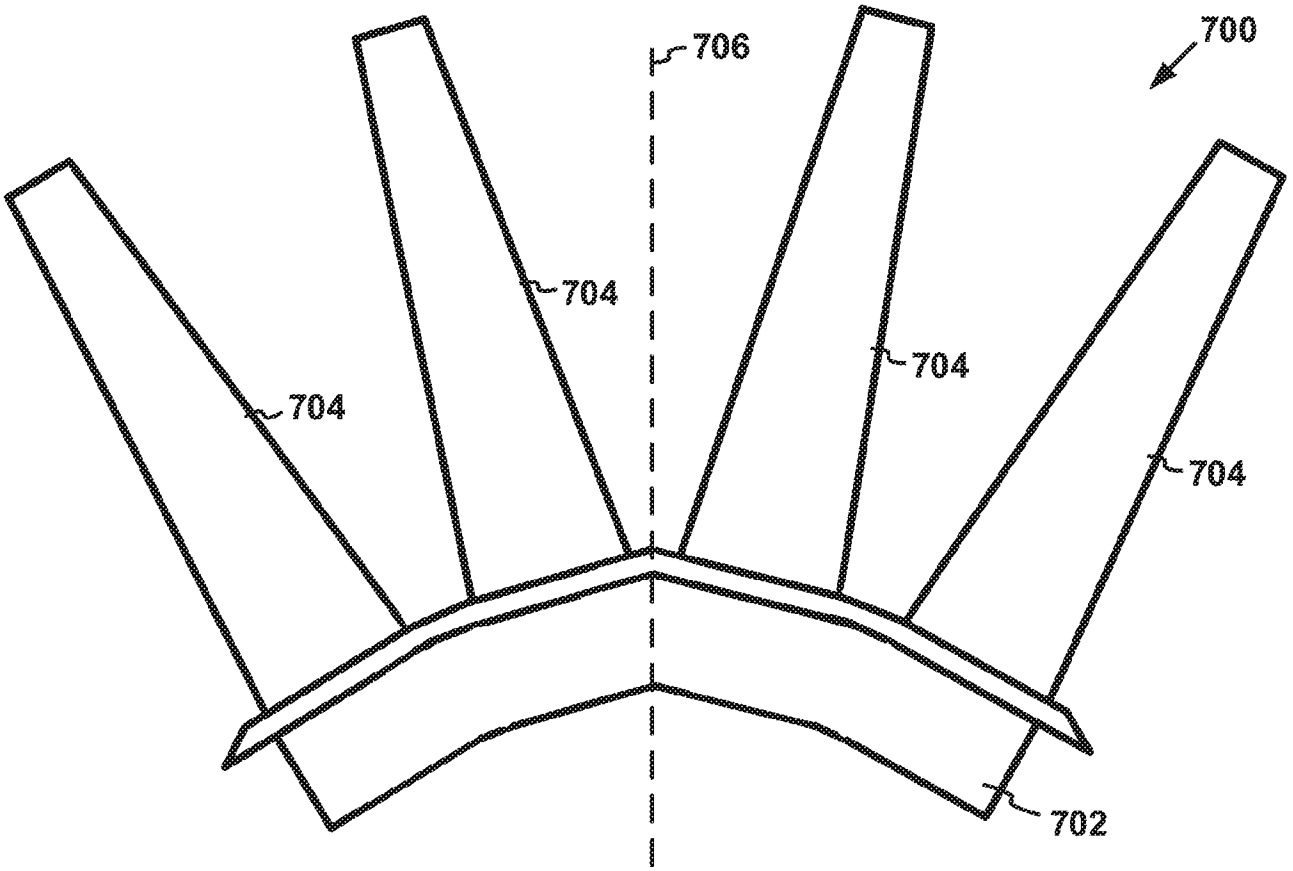
FIG. 7 illustrates a schematic view of a CMC bladed disk component.

FIG. 7 illustrates a schematic example of a portion of the CMC bladed disk 700 or CMC bladed disk component that is formed by infiltration of the bladed disk preform 100. As shown in FIG. 7 the CMC bladed disk component 700 may include a single root 702 with multiple blades 704 extending from the root 702. In some examples, the CMC bladed disk component 700 may be cut along cut lines 706 to form multiple CMC bladed disk segments having a root 702 and multiple blades 704. For example, each of the CMC bladed disk segments may have a single root 702 and two or three blades. The CMC bladed disk segments may be fixed to the hub of the gas turbine engine. In other examples the root 702 may be annular, so that the entire CMC bladed disk 700 may be a unitary annular piece (not shown). In this example, the unitary annular piece may be fixable to the hub of the gas turbine engine.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

A first aspect relates to a method comprising: forming or providing a plurality of sheets, wherein each of the sheets includes a plurality of ceramic fibers; cutting a plurality of slots in each of the sheets, the slots extending from an outer edge of the sheets inward toward a center of the sheets; stacking and forming the sheets on top of each other to form a bladed disk preform, which is porous, wherein the bladed disk preform includes a plurality of blade portions extending outward from a root portion, and wherein each of the slots is positioned between adjacent blade portions.

A second aspect relates to the method of aspect 1, further comprising cutting a hole in each of the sheets, wherein the bladed disk preform is an annulus.

A third aspect relates to the method of any preceding aspect, wherein each of the sheets comprises a woven cloth, the woven cloth including a first set of ceramic fibers and a second set of ceramic fibers, wherein the first set of ceramic fibers is arranged orthogonal to the second set of ceramic fibers.

A fourth aspect relates to the method of any preceding aspect, wherein each of the sheets comprises a polar woven cloth, the polar woven cloth including a first set of ceramic fibers and a second set of ceramic fibers, wherein the first set of ceramic fibers are arranged around a center of the sheets to extend outward from the center, and wherein the second set of ceramic fibers is arranged in concentric arcs around the center of the sheets.

A fifth aspect relates to the method of any preceding aspect, wherein each of the sheets has a disk shape.

A sixth aspect relates to the method of any preceding aspect, further comprising cutting through the root portion along a plane extending through the root portion between adjacent blade portions to form a plurality of bladed disk preform segments.

A seventh aspect relates to the method of any preceding aspect, further comprising infiltrating the bladed disk preform segments; and forming a plurality of ceramic matrix composite (CMC) bladed disk segments, wherein each of the CMC bladed disk segments includes a blade and a root.

An eighth aspect relates to the method of any preceding aspect, wherein the root is fixable to a hub of a gas turbine engine.

A ninth aspect relates to the method of any preceding aspect, wherein each of the bladed disk preform segments includes at least two blade portions.

A tenth aspect relates to a method comprising: forming or providing a plurality of sheets, wherein each of the sheets includes a plurality of ceramic fibers; stacking and forming the sheets on top of each other to form a porous preform, the porous preform having an outer edge; and cutting a plurality of slots in the porous preform, the slots extending from an outer surface of the porous preform inward toward a center of the porous preform to define a bladed disk preform, the bladed disk preform including a plurality of blade portions and a root portion.

An eleventh aspect relates to the method of any preceding aspect, wherein each of the sheets has an annular shape.

A twelfth aspect relates to the method of any preceding aspect, wherein the ceramic fibers include a first set and a second set of the ceramic fibers, wherein the first set of ceramic fibers comprises a different material than the second set of ceramic fibers.

A thirteenth aspect relates to the method of any preceding aspect, wherein the ceramic fibers include a first set and a second set of the ceramic fibers, wherein the first set of ceramic fibers comprises a different thickness than the second set of ceramic fibers A fourteenth aspect relates to the method of any preceding aspect, further comprising infiltrating the bladed disk preform with molten metal or alloy; and forming a ceramic matrix composite (CMC) bladed disk, wherein each of the CMC bladed disk including a plurality of blades extending away from a root.

A fifteenth aspect relates to the method of any preceding aspect, further comprising cutting through the root between along a plane extending through the root portion between adjacent blades to produce CMC bladed disk segments, wherein each of the CMC bladed disk segments includes a portion of the root and at least two blades.

A sixteenth aspect relates to the method of any preceding aspect, wherein each of the CMC bladed disk segments is configured to be fixed to a hub of the gas turbine engine.

A seventeenth aspect relates to a ceramic matrix composite (CMC) bladed disk component comprising: a unitary piece including a plurality of blades and a root portion, the blades extending away from the root portion, wherein the blades and the root portion comprise CMC.

An eighteenth aspect relates to the method of any preceding aspect, wherein the root portion is fixable to a hub of a gas turbine engine.

A nineteenth aspect relates to the method of any preceding aspect, wherein the unitary piece is a contiguous annular structure.

A twentieth aspect relates to the method of any preceding aspect, wherein the unitary piece comprises a plurality of unitary pieces coupled to one another in an annular structure.

In addition to the features mentioned in each of the independent aspects enumerated above, some examples may show, alone or in combination, the optional features mentioned in the dependent aspects and/or as disclosed in the description above and shown in the figures.

What is claimed is:

1. A method comprising:

forming or providing a plurality of sheets, wherein each of the sheets includes a plurality of ceramic fibers;

cutting a plurality of slots in each of the sheets before each of the sheets is stacked on one or more of other of the plurality of sheets, the slots extending from an outer edge of the sheets inward toward a center of the sheets;

stacking and forming the sheets on top of each other to form a bladed disk preform, which is porous, wherein the bladed disk preform includes a plurality of blade portions extending outward from a root portion, and wherein each of the slots is positioned between adjacent blade portions.

2. The method of claim 1, further comprising cutting a hole in each of the sheets, wherein the bladed disk preform is an annulus.

3. The method of claim 1, wherein each of the sheets comprises a woven cloth, the woven cloth including a first set of ceramic fibers and a second set of ceramic fibers, wherein the first set of ceramic fibers is arranged transverse to the second set of ceramic fibers.

4. The method of claim 1, wherein each of the sheets comprises a polar woven cloth, the polar woven cloth including a first set of ceramic fibers and a second set of ceramic fibers, wherein the first set of ceramic fibers are arranged around a center of the sheets to extend outward from the center, and wherein the second set of ceramic fibers is arranged in concentric arcs around the center of the sheets.

5. The method of claim 1, wherein each of the sheets has a disk shape.

6. The method of claim 1, further comprising cutting through the root portion along a plane extending through the root portion between adjacent blade portions to form a plurality of bladed disk preform segments.

7. The method of claim 6, further comprising infiltrating the bladed disk preform segments; and forming a plurality of ceramic matrix composite (CMC) bladed disk segments, wherein each of the CMC bladed disk segments includes a blade and a root.

8. The method of claim 7, wherein the root is fixable to a hub of a gas turbine engine.

9. The method of claim 6, wherein each of the bladed disk preform segments includes at least two blade portions.

10. A method comprising:

forming or providing a plurality of sheets, wherein each of the sheets includes a plurality of ceramic fibers;

stacking and forming the sheets on top of each other to form a porous preform, the porous preform having an outer edge;

cutting a plurality of slots in the porous preform, the slots extending from an outer surface of the porous preform inward toward a center of the porous preform to define a bladed disk preform, the bladed disk preform including a plurality of blade portions and a root portion;

cutting through the root portion along a plane extending through the root portion between adjacent blades of the plurality of blade portions to form a plurality of bladed disk preform segments; and after cutting through the root portion to form the plurality of bladed disk preform segments, infiltrating each of the plurality of bladed disk preform segments to form a plurality of ceramic matrix composite (CMC) bladed disk segments, wherein each of the plurality of CMC bladed disk segments includes a root and at least one blade extending away from the root.

11. The method of claim 10, wherein each of the sheets has an annular shape.

12. The method of claim 11, wherein the ceramic fibers include a first set and a second set of the ceramic fibers, wherein the first set of ceramic fibers comprises a different material than the second set of ceramic fibers.

13. The method of claim 12, wherein the ceramic fibers include the first set and the second set of the ceramic fibers, wherein the first set of ceramic fibers comprises a different thickness than the second set of ceramic fibers.

14. The method of claim 13, wherein each of the sheets comprises a woven cloth formed by the first set and the second set of the ceramic fibers.

15. The method of claim 14, wherein the woven cloth comprises a polar woven cloth.

16. The method of claim 10, wherein each of the CMC bladed disk segments is configured to be fixed to a hub of a gas turbine engine.

* * * * *